US006070362A

United States Patent [19]

Strassel

[11] Patent Number: 6,070,362

[45] Date of Patent: Jun. 6, 2000

[54] ADJUSTABLE HINGING FITTING FOR A DOOR OR WINDOW

[75] Inventor: Richard Strassel, Berthelming, France

[73] Assignee: Ferco International Ferrures et Serrures de Bâtiment Société Anonyme, Sarrebourg, France

[21] Appl. No.: 08/898,815

[22] Filed: Jul. 23, 1997

[30] Foreign Application Priority Data

Jul. 31, 1996 [FR] France ..... 96 09843

[51] Int. Cl.[7] ..... E05D 15/52

[52] U.S. Cl. ..... 49/192; 49/193

[58] Field of Search ..... 49/161, 162, 192, 49/193, 388, 389, 390; 16/224, 233, 235, 236, 237, 238, 239, 367

[56] References Cited

U.S. PATENT DOCUMENTS

| | | | |
|---|---|---|---|
| 1,169,566 | 1/1916 | Prieskorn | 16/224 |
| 1,639,441 | 8/1927 | Spahr | 16/224 |
| 2,184,259 | 12/1939 | Seaman | 16/224 |
| 2,714,835 | 8/1955 | Ogle, Jr. | 16/224 |
| 3,036,331 | 5/1962 | Skolnik | 16/224 |
| 3,048,899 | 8/1962 | Vincent | 49/193 |
| 3,406,483 | 10/1968 | Mitchell | 16/224 |
| 3,588,946 | 6/1971 | MacDonald | 16/224 |
| 4,339,892 | 7/1982 | Ulbricht et al. | 16/192 |
| 4,420,905 | 12/1983 | Kucharczyk | 49/192 |
| 4,916,926 | 4/1990 | Shieh | 16/337 |
| 4,980,946 | 1/1991 | Verasani et al. | 16/224 |
| 5,052,077 | 10/1991 | Lautenschlager et al. | 16/238 |
| 5,052,079 | 10/1991 | Vosskotter | 49/192 |
| 5,076,015 | 12/1991 | Manzalini | 49/192 |
| 5,263,227 | 11/1993 | Hrbek et al. | 16/224 |

*Primary Examiner*—Daniel P. Stodola
*Assistant Examiner*—Curtis A. Cohen
*Attorney, Agent, or Firm*—Harrison & Egbert

[57] ABSTRACT

A hinging fitting for joining a sash-frame to a leaf in which the hinging fitting has a fixed support adapted to be attached to the sash-frame, a movable support adapted to be attached to the leaf, a spindle pivotally affixed on the fixed support and a bushing affixed to the movable support. The spindle is subdivided into at least two spindle lengths. At least one of the spindle lengths is offset from a longitudinal axis of another spindle length. The bushing has a bore formed by at least two elongated holes arranged substantially in an extension of each other. The elongated holes receive respectively the spindle lengths.

11 Claims, 3 Drawing Sheets

ADJUSTABLE HINGING FITTING FOR A DOOR OR WINDOW

BACKGROUND OF THE INVENTION (1) Field of the Invention

The invention relates to a hinging fitting, for a door, window or the like, comprising a fixed support inserted on the sash-frame and on which is installed a spindle in a movable support attached to the leaf inserted into a bushing.

This invention will find its application in the field of the building iron-mongery and relates, in particular, to hinging fittings for a door, window or the like.

(2) Description of the Prior Art

As a matter of fact, there are already known a number of hinging fittings meeting the above description and ensuring the pivoting connection of a door, window or the like to a sash-frame. In closer compliance with this description are the bent supports which ensure the lower connection between a sash-frame and a leaf pivoting about a vertical axis. In this respect, one observes that such a bent support may also fulfill the function of allowing a tilting of this leaf about a horizontal axis at the lower edge of the leaf. This is used in the framework of a swinging and tilting-type door or window.

Thus, such a bent support includes a fixed support attached with the sash-frame and which may be of various configurations related to the material of the leaf and sash-frame. On this fixed support is installed a spindle, through appropriate connecting means. In this respect, within the framework of a swinging and tilting leaf, these connecting means are, in the shape of ball-pin hinge. The spindle is then provided, at its lower end, with a spherical head accomodating itself in a ball-pin cage which is part of the fixed support. Finally, though the bushing corresponding to the movable support attached to the sash-frame is capable of pivoting about a vertical spindle, the tilting is the result of the mounting of the ball pin on the fixed support.

Very often, this kind of hinging fitting includes, adjusting means allowing the adjustment of the positioning of the leaf with respect to its sash-frame. Thus, these adjusting means act in the plane of the door, window or the like and/or in a perpendicular direction. This function being, in this latter case, to modify the force of compression of the leaf against the sash-frame when closing the door, window or the like.

Thus, it is known to carry out an adjustment of the compression of the seal between the leaf and its sash frame by acting on the components of the movable support attached to the leaf or on the movable members integral with the sash-frame.

Furthermore, there are known various embodiments of adjusting devices allowing to achieve the tilting of the leaf to the left or to the right in the plane of the sash-frame. Such adjustment devices may act on the connection between the spindle and the fixed support of the sash-frame. The drawback of this solution is its complexity, because of the additional parts it requires. This obviously results in an increased production cost, in addition to the fact that these additional parts are liable, in the course of time, to getting jammed because of their oxidizing. Additionally the presence of dust or dirt may make the successive adjustments impossible.

SUMMARY OF THE INVENTION

The present invention facilitates the adjustment of the positioning of a leaf with respect to its sash-frame without increasing the complexity of the hinging fitting. The invention provides such a benefit regardless of whether the positioning of the leaf is adjusted perpendicular or parallel to the sash-frame. In this respect, in a more advanced embodiment, this invention allows the user to select at will such direction.

To this end, the invention relates to a hinging fitting, comprising a fixed support inserted on the sash-frame and on which is installed a spindle inserted into a bushing on a movable support attached to the leaf. This hinging fitting:

- the spindle is pivotally installed on the fixed support and is subdivided into at least two spindle lengths at least one of which is offset with respect to the other one,
- the bushing has a bore formed by at least two elongated holes arranged substantially in the extension of each other and each receiving one of the spindle lengths.

According to the invention, the tranverse cross-section of an elongated hole matches the circular cross-section of the spindle length it must receive.

According to another feature of the invention, the elongated holes are oriented perpendicular to each other.

According to an advanced embodiment of the invention, the bushing is internally fitted by a sleeve having a bore formed by two elongated holes.

The advantages resulting from this invention result from the ability to simply controllably rotate the spindle such that its offset length acts on the bushing of the movable support transversely to the longitudinal direction of the elongated hole receiving this eccentered spindle length.

Thus, according to the orientation of the elongated hole receiving the offset spindle length (parallel or perpendicular to the plane of the sash-frame), the rotation of the spindle results in moving the leaf perpendicular or parallel to, to the sash-frame. It should be noticed that the other, spindle length is freely movable in translation in this direction of adjustment.

Accordingly, this invention results in the fact that one and the same solution can be adopted to ensure the adjustment of the leaf as to its compression against the frame or in a direction parallel to the plane of the sash-frame.

Finally, the user or an installer may at any time choose the direction in which he wants to act on the leaf.

The invention will be better understood when reading the following description with reference to the attached drawings corresponding to an exemplary embodiment.

DESCRIPTION OF THE PREFERRED EMBODIMENTS

Figure 1:
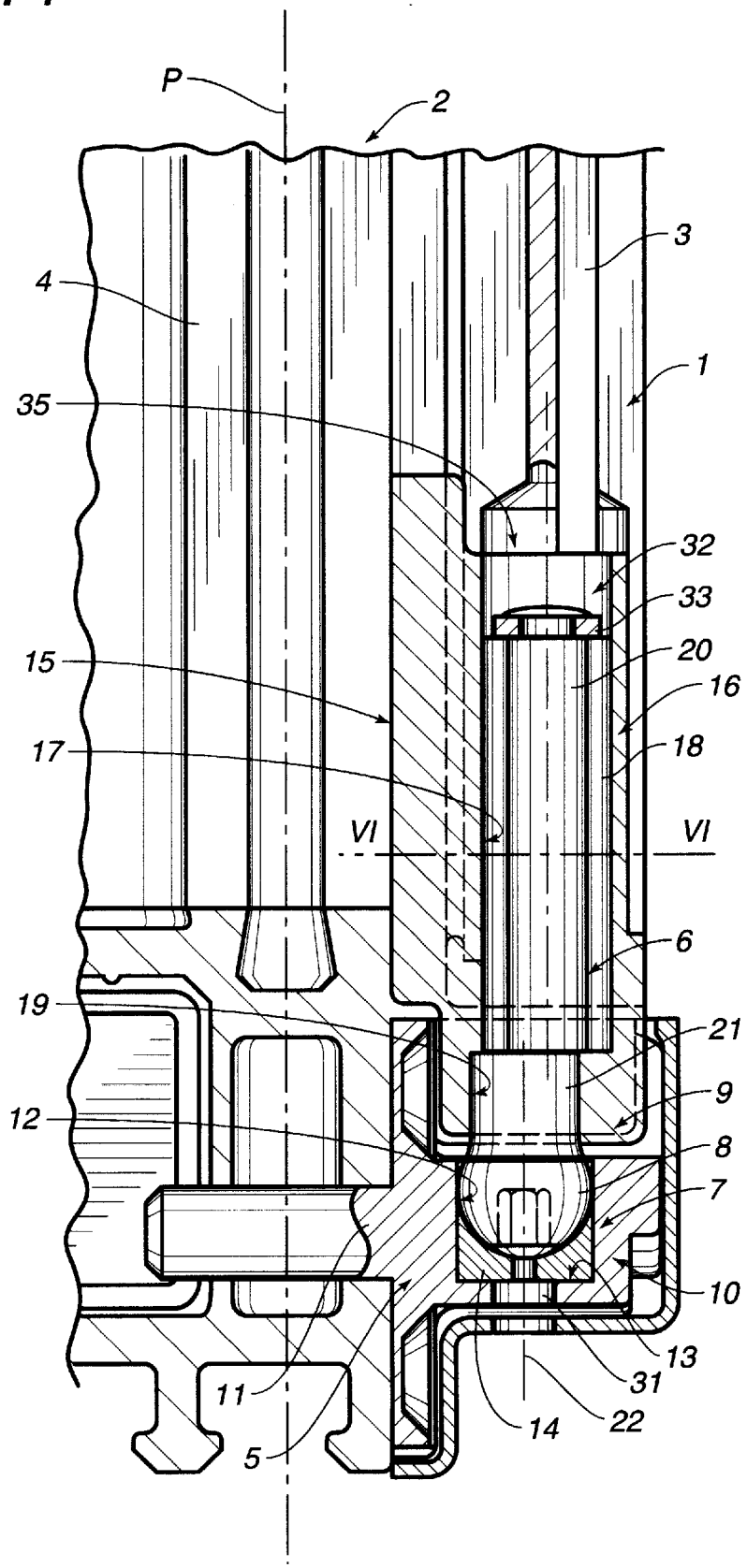
FIG. 1 is a schematical and cross-sectional view transverse to the plane of a window showing a hinging fitting according to the invention authorizing an adjustment of the leaf in a direction parallel to the plane of the sash-frame.
Figure 2:
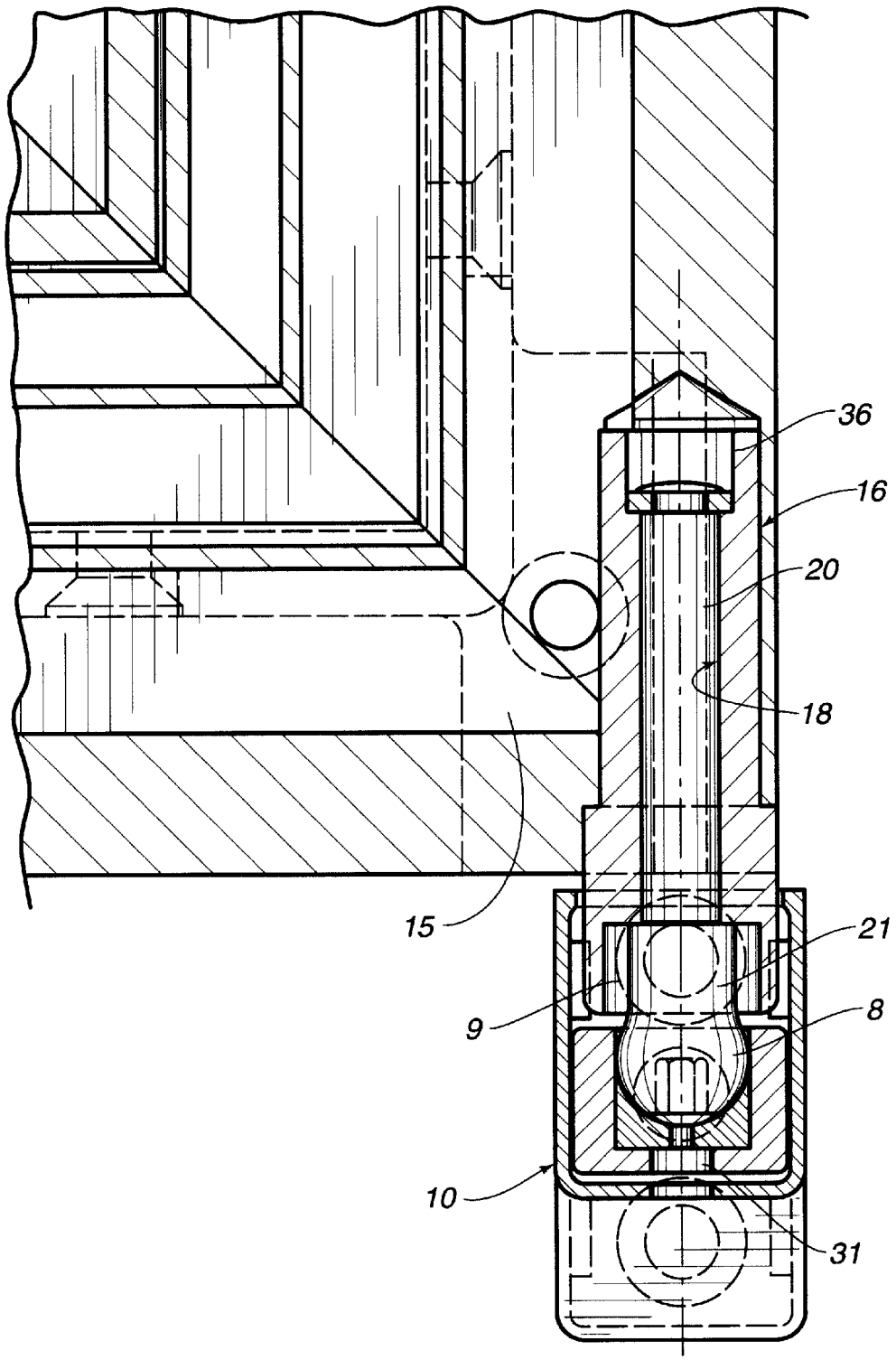
FIG. 2 is a schematical view of this same hinging fitting as shown in FIG. 1, according to a perpendicular cross-sectional plane, i.e. parallel to the plane of the sash-frame.
Figure 3:
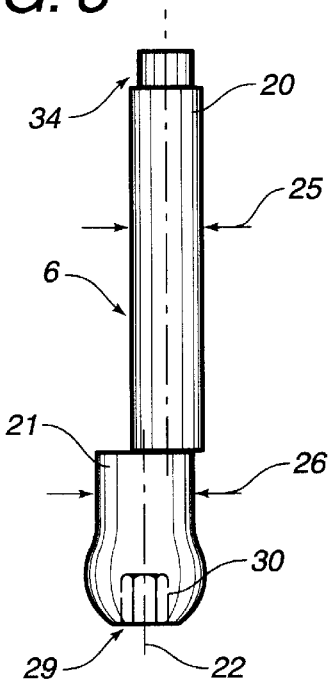
FIG. 3 is a schematical and elevational view of the spindle.

As shown in FIGS. 1 and 2 of the attached drawings, this invention relates to a hinging fitting 1 for a door, window or the like, the leaf 3 and the sash-frame 4 of which are shown only partially.

The hinging fitting 1 has a bent support which ensures the lower hinged connection of the leaf 3 in this case about a vertical spindle, to the sash-frame 4.

Thus, this hinging fitting 1 includes a fixed support 5 inserted on the sash-frame 4 and on which is installed a spindle 6 embodying the axis of pivoting of the leaf 3 with respect to this sash-frame 4.

According to the invention, this spindle 6 is pivotally mounted on the fixed support 5. This actual connection between this spindle 6 and this fixed support 5 is achieved through hinging means 7 in the shape of a ball pin allowing the tilting of the leaf 3 with respect to the sash-frame 4. Thus, such hinging means 7 in the shape of a ball pin are defined by a spherical head 8 provided for at the lower end 9 of the spindle 6 and inserted into a ball-pin cage 10 affixed to the fixed support 5. This ball-pin cage 10 is substantially in the shape of a casing 11 having a recess 12 the cross-section of which matches the spherical head 8. At the bottom 13 of this recess 12 is arranged a bearing 14 having a concave track for receiving spherical head 8.

This hinging fitting 1 includes a movable support 15 which is affixed to the leaf 3 and is provided with a bushing 16 having a bore 17 for receiving the spindle 6.

In this respect, according to the invention, this bore 17 is formed by at least two elongated holes 18, 19 arranged substantially in the extension of each other. The spindle 6 is subdivided into at least two spindle lengths one 20 of which is received in one 18 of the elongated holes, whilst the other one 21 engages into the other elongated hole 19. At least one 20 of these lengths 20, 21 of the spindle 6 is offset with respect to the axis of pivoting 22 of the spindle 6 about the fixed support 5.

As far as the elongated holes 18, 19 are concerned, they have a transverse cross-section 23, 24 matching the cylindrical section 25, 26, respectively, of the spindle length 20, 21 they will receive. Accordingly, these spindle lengths 20, 21 have some mobility inside these elongated holes 18, 19 in the longitudinal direction 27, 28 of these holes, 18, 19.

According to another feature of the invention, the elongated holes 18, 19 are preferably oriented such that the longitudinal axes of the holes 18, 19 is perpendicular to each other.

By controllably rotating the spindle 6, the eccentered spindle length 20 urges the bushing 16 towards a direction exclusively transverse to the longitudinal direction 27 of the elongated hole 18 in which it is engaged. The other spindle length 21 moves in the longitudinal direction 28 in the elongated hole 19.

If we now assume that the lower spindle length 21 is offset from the axis of rotation 22, and not the other one 20, the force by the spindle 6 on the bushing 16 during the rotation of the spindle 6 will be perpendicular to the one described above.

It should be noticed, by the way, that this allows one to perfectly define the direction in which one wants to move the leaf 3 during the adjustment of its position with respect to the sash-frame 4.

Turning back now to the embodiment shown in the drawings and corresponding to the case in which the elongated hole 18 receiving the offset spindle length 20 is so oriented that its longitudinal direction 27 is transverse to the plane P of the sash-frame 4, the rotation of the spindle 6 results into a displacement of the leaf 3 in a direction parallel to the plane P.

Assuming that the elongated hole 18 is turned by a quarter turn or that the spindle length 21 is eccentered instead of the other one 20, the control in rotation of the spindle 6 transmits onto the leaf 3 an action perpendicular to the plane of the sash-frame 4.

Thus, from the foregoing description one understands that it is enough, depending on the adjustment one wants to make, to accordingly orient the elongated holes 18, 19 or to offset one spindle length 20 with respect to the other one 21.

In this respect, there is a more advanced embodiment in which the cylindrical bore of the bushing 16 is fitted with a sleeve which has the bore 17 in the shape of elongated holes 18, 19 arranged substantially in the extension of each other. Here too, the longitudinal directions 27, 28 of the elongated holes 18, 19 are oriented transverse to each other. Thus, by rotating the sleeve inside the bushing 16 by a quarter turn, one can go from the adjustment of the leaf perpendicular to the sash-frame 4 to adjusting this leaf in a direction parallel to this plane of the sash-frame 4. It should be noticed that by imparting to this sleeve an intermediate angular position, the rotation of the spindle 6 leads to a combined motion of the leaf 3 with respect to the sash-frame 4.

Generally, this rotation of the spindle 6 is achieved through appropriate means 29. In particular, these means 29 are in the shape of a recess 30 made at the lower end 9 of this spindle 6. This recess serves to receive a tool passing through an opening 31 provided for in the bottom 13 of the ball-pin cage 10. Thus, this recess 30 is preferably under the spherical head 8 and shaped for receiving a hexagonal spanner.

It should be noticed, in this respect, that once the adjustments have been carried out, the spindle 6 should be fixed against in rotation inside the bushing 16. This fixing can be achieved through classical means, such as a screw passing through a tapped hole in the wall of the bushing 16 so as to co-operate with the spindle 6.

According to another embodiment, these means for locking the spindle 6 in rotation with respect to the bushing 16 include a means 32 for assemblying these parts by clamping.

In particular, according to a preferred embodiment shown in the drawings, the means 32 are in the shape of a locking washer 33 affixed to the free end 34 of the spindle 6 upon mounting same in the bushing 16 and exerting a certain axial clamping torque on this spindle 6 with respect to the bushing 16.

Instead of being located on the free end 35 of the bushing 16, this locking washer 33 may be positioned in a bore 36 this free end 35 of the bushing 16, in the extension of the elongated hole 18. This bore 36 is of course so defined as to allow the displacement of the length 20 of the spindle 6 in a longitudinal direction 27 inside the elongated hole 18.

It should be noticed that such a locking washer 33 axially retains the spindle 6 inside the bushing 16 during the mounting of the leaf 3 onto the sash-frame 4.

Figure 4:
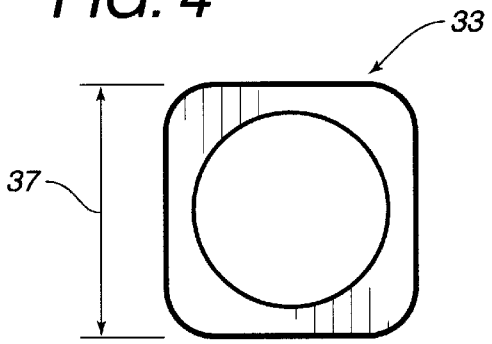
FIG. 4 is a schematical view of the locking washer riveted to the free end of the spindle shown in FIG. 3.
Figure 5:
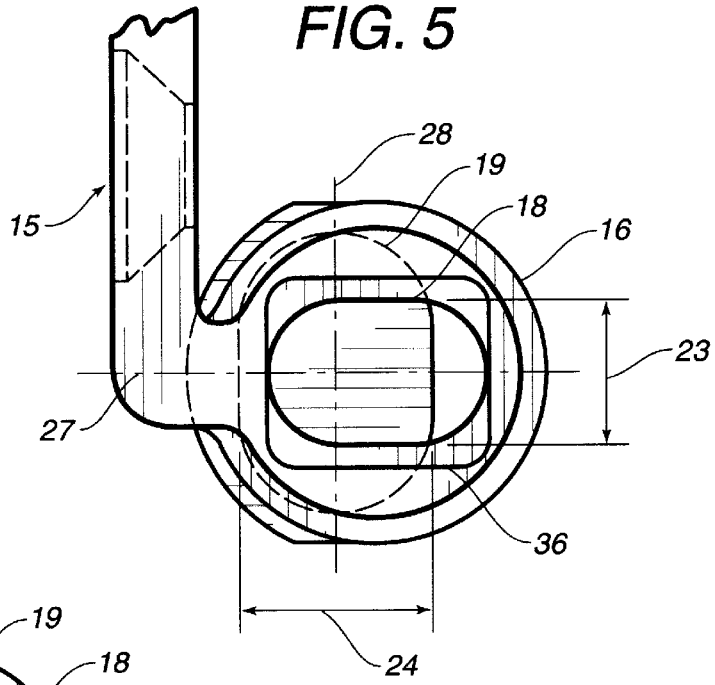
FIG. 5 is a plan view of the bushing corresponding to the movable support showing both elongated holes oriented perpendicularly to each other.
Figure 6:
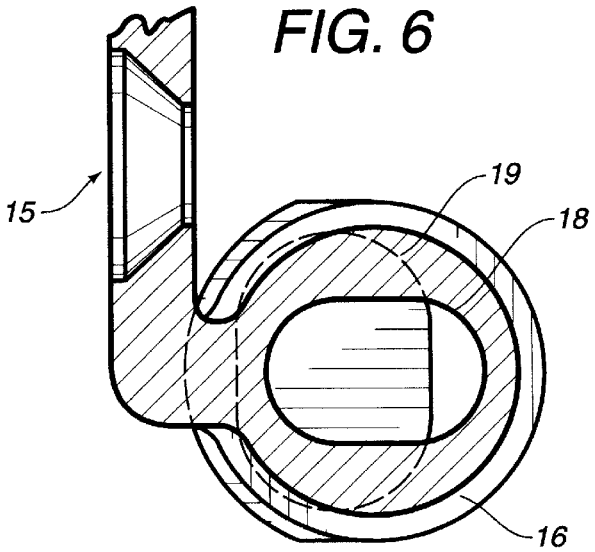
FIG. 6 is a cross-sectional view along VI—VI of FIG. 1.

As shown in FIG. 4, this locking washer 33 further has a square shape. The sides 37 of this locking masher 33 match the transverse cross-section 38 of the bore 36. Thus, the fixing of the rotation of the spindle 6 with respect to the bushing 16 can result from the locking in rotation of the locking washer 33 with respect to the bushing 16, and the force of its crimping on the free end 34 of the spindle 6.

Thus, as appears from the preceding description, the hinging fitting, allows the user or the installer to proceed to accurate adjustments of the leaf of a door or window with respect to its sash-frame, while maintaining a simple design which is therefore reliable in the course of time.

I claim:

1. A hinging fitting for joining a sash-frame to a leaf, the hinging fitting comprising:

a fixed support adapted to be attached to the sash-frame;

a movable support adapted to be attached to the leaf;

a spindle rotatable affixed on said fixed support, said spindle being subdivided into at least two spindle lengths each having a circular transverse cross-section, one of said spindle lengths being offset from a longitudinal axis of another spindle length; and a bushing affixed to said movable support, said bushing having a bore formed by two holes of elongated cross-section substantially aligned in an axial direction with each other, said holes receiving respectively said spindle lengths, each of said holes having said elongated cross-section sized to receive the circular transverse cross-section of the respective spindle length therein, each of said holes having a longitudinal axis in the elongated cross-section, the longitudinal axis of one of said holes being transverse to the longitudinal axis of the other elongated hole; one of said spindle lengths being adjustably movable within the respective hole such that the leaf can be adjusted in a plane parallel to the sash-frame, the other spindle length being adjustably movable in the respective hole such that the leaf can be adjusted in a plane perpendicular to the sash-frame.

2. The hinging fitting of claim 1, said spindle having means thereon for rotating said spindle relative to said bushing.

3. The hinging fitting of claim 2, said spindle having a spherical head at one end, said fixed support having a ball-pin cage affixed thereto, said spherical head received within said ball-pin cage, said spherical head having a recess formed at a bottom thereof, said ball-pin cage having a bottom with an opening extending therethrough, said opening having a size suitable for allowing a tool to pass therethrough so as to access said recess.

4. The hinging fitting of claim 3, said recess having a hexagonal shape.

5. The hinging fitting of claim 1, further comprising:

fixing means attached to either of said bushing or said spindle, said fixing means for preventing rotation of said spindle within said bushing.

6. The hinging fitting of claim 5, said fixing means comprising a screw affixed within a tapped hole extending through a wall of said bushing, said screw engaging said spindle.

7. The hinging fitting of claim 5, said fixing means comprising a locking washer affixed onto an upper end of said spindle so as to create an axial clamping force upon said bushing so as to prevent rotation of said spindle with respect to said bushing.

8. The hinging fitting of claim 7, said bushing having a free end with a recess formed in said bore, said locking washer received by said recess.

9. The hinging fitting of claim 5, said fixing means comprising a locking washer crimped onto an upper end of said spindle, said locking washer engaging said bushing so as to prevent relative rotation between said spindle and said bushing.

10. The hinging fitting of claim 9, said bushing having a free end with a recess formed therein, said recess receiving said locking washer.

11. The hinging fitting of claim 1, said bore of said bushing having a sleeve fitted therein, said sleeve having a shape corresponding to said holes.

* * * * *